US007557712B2

(12) United States Patent
Shelton et al.

(10) Patent No.: US 7,557,712 B2
(45) Date of Patent: Jul. 7, 2009

(54) SYSTEMS AND METHOD FOR MONITORING EQUIPMENT

(75) Inventors: Jerry Shelton, Boise, ID (US); Michael J. Shelton, Boise, ID (US); Curtis Gold, Boise, ID (US); Charles Fuqua, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 382 days.

(21) Appl. No.: 11/540,872

(22) Filed: Sep. 29, 2006

(65) Prior Publication Data

US 2008/0079580 A1 Apr. 3, 2008

(51) Int. Cl.
*G08B 13/14* (2006.01)

(52) U.S. Cl. ..... 340/572.4; 340/5.61; 340/539.11

(58) Field of Classification Search ..... 340/572.1, 340/572.4, 573.1, 573.4, 539.11, 5.2, 5.3, 340/5.6, 5.61, 5.64
See application file for complete search history.

(56) References Cited

U.S. PATENT DOCUMENTS

| | | | | |
|---|---|---|---|---|
| 5,796,827 | A | 8/1998 | Coppersmith et al. | |
| 5,886,634 | A * | 3/1999 | Muhme | 340/572.1 |
| 5,959,530 | A * | 9/1999 | Lupien et al. | 340/5.61 |
| 5,963,134 | A * | 10/1999 | Bowers et al. | 340/572.1 |
| 6,232,877 | B1 * | 5/2001 | Ashwin | 340/572.1 |
| 6,300,872 | B1 * | 10/2001 | Mathias et al. | 340/572.4 |
| 7,076,441 | B2 | 7/2006 | Hind et al. | |
| 2005/0128083 | A1 | 6/2005 | Puzio et al. | |
| 2006/0186201 | A1 | 8/2006 | Hart | |

FOREIGN PATENT DOCUMENTS

| | | |
|---|---|---|
| EP | 0 843 425 B1 | 3/2003 |
| WO | 99/45498 | 9/1999 |

OTHER PUBLICATIONS

International Search Report for PCT/US2007/079278, Based on US Priority Application [U.S. Appl. No. 11/540,872]. Report Issued Apr. 1, 2008.

Breidenbach, Ann; "Tracking Wafers with RFID"; Journal-Sensors; Feb. 1, 2006; vol. 23; No. 2 (Abstract Only).

Anon; "Application of tracking technology to access-control system"; Journal-Hitachi Review; Jun. 2004; 83-87; vol. 53; No. 2 (Abstract Only).

(Continued)

*Primary Examiner*—Thomas J Mullen

(57) ABSTRACT

A system for monitoring equipment includes at least one sensor generating a detection field; an electronic equipment tag associated with a piece of secured equipment; an electronic personnel tag identifying a person; and a server, in communication with the at least one sensor, for matching detection in the detection field of the equipment tag with detection in the detection field of a personnel tag and determining whether a person identified by the detected personnel tag is authorized to use equipment corresponding to the detected equipment tag. A method of monitoring equipment includes detecting a electronic equipment tag associated with a piece of secured equipment in a detection field; detecting a personnel tag identifying a person in the detection field; and determining if the person identified by the detected personnel tag is authorized to use equipment corresponding to the detected equipment tag.

21 Claims, 7 Drawing Sheets

OTHER PUBLICATIONS

Van Renesse, Rudolf L.; "Optical security and counterfeit deterrence techniques"; Conference Volume-SPIE Proceedings; Feb. 1996; vol. 2659; CA; U.S.A. (Abstract Only).

"On-demand occupancy and product usage data tracking system for seated venues"; Jun. 9, 2005 (Abstract Only).

Brown, Bradford C.; "Air Societal Concerns To Fill Innovation Gaps"; Journal-Information Week; Sep. 6, 2004; 66; No. 1004; CMP Media LLC; U.S.A. (Abstract Only).

Witt, Clyde E.; "Dock Efficiency: Last Things First"; Journal-Material Handling Management; Jun. 1, 2004; 57-67; vol. 59; No. 6; Penton Media, Inc. (Abstract Only).

* cited by examiner

SYSTEMS AND METHOD FOR MONITORING EQUIPMENT

BACKGROUND

Securing storage and transfer of items is a top priority for sensitive, expensive, or hard to replace equipment. Keeping such items in relatively unsecured areas may unfortunately result in equipment loss, either through inadvertent misplacement or actual theft.

At a basic level, logs can be kept to record the movement of important equipment. For example, someone taking or moving the equipment is required to sign the log or make a log entry to indicate who has taken the equipment. Personnel can be used to monitor such a log and to ensure that it is signed when equipment is taken. The personnel monitoring the log can also ensure that the log signer has accurately identified himself or herself in the log. This, however, requires the expense of having personnel present to monitor the log.

On the other hand, if the log is not monitored, it becomes easy for those taking equipment to either falsify the log or simply not make an entry at all when equipment is removed. A false entry can be made that either incorrectly identifies the equipment taken or incorrectly identifies the person taking the equipment. Alternatively, if no personnel are enforcing the use of the log, equipment can simply be taken without any entry in the log being made.

A person removing equipment without making a log entry may be intending to steal the equipment or may simply intend to use and return the equipment, not wanting to be bothered with making a log entry. In the latter case, even though the borrower does not intend to steal the equipment, the equipment may still be damaged, forgotten or loaned to another worker without any record of where it has gone.

BRIEF DESCRIPTION OF THE DRAWINGS

The accompanying drawings illustrate various embodiments of the principles described herein and are a part of the specification. The illustrated embodiments are merely examples of the present invention and do not limit the scope of the claims.

Throughout the drawings, identical reference numbers designate similar, but not necessarily identical, elements.

DETAILED DESCRIPTION

The present specification describes systems and methods that monitor both the removal of equipment from a storage location and the identity of the person moving the equipment. The system monitors both an electronic tag on the secured equipment and a corresponding electronic tag carried by personnel. If movement of the secured equipment is detected without the presence of a tag identifying personnel authorized to move that equipment, measures can be taken to prevent the unauthorized taking of the equipment or to alert security or management personnel to the unauthorized taking of the equipment.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As used herein and in the appended claims, the term "equipment" will be used broadly to refer to any physical item or object that it is desired to secure and monitor to prevent theft or unauthorized use. For example, equipment includes, but is not limited to, tools, electronics, files or papers, books, memory devices, chemicals, medicines, drugs, weapons, etc.

Figure 1:
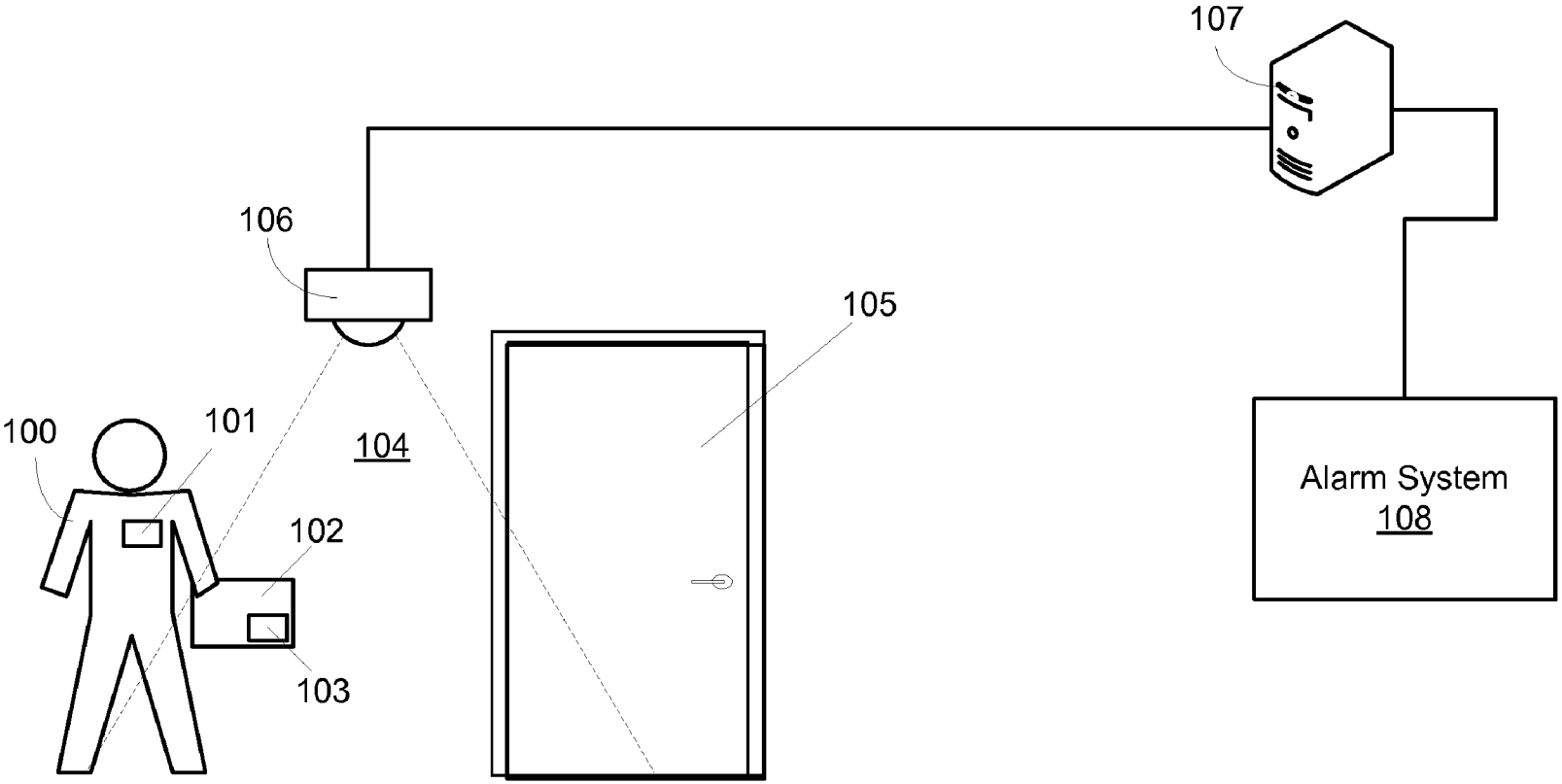
FIG. 1 is an illustration of a system according to one exemplary embodiment of the principles described herein that monitors both the removal of equipment from a storage location and the identity of the person moving the equipment.

FIG. 1 is an illustration of a system according to principles described herein that monitors both the removal of equipment from a storage location and the identity of the person moving the equipment. As shown in FIG. 1, a piece of secured equipment (102) is retained in a storage room or location. The secured equipment (102) has an electronic tag (103) that is associated with the equipment (102).

The electronic tag (103) can be affixed to the exterior or interior of the equipment (102). Alternatively, the electronic tag (103) can be associated with the secured equipment (102) in some other way, for example, by being removably attached to the secured equipment (102), being tethered to the secured equipment (102) or attached to something that is, in turn, attached to or associated with the secured equipment (102). Any association between the secured equipment (102) and the electronic tag (103) can be used. It will be appreciated, however, that the more irrevocably the electronic tag (103) is associated with the secured equipment (102), the more difficult it will be to make an unauthorized movement of the secured equipment (102) by, for example, removing the electronic tag (103).

The electronic tag (103) can be, for example, a Radio Frequency Identification (RFID) tag. An RFID tag used as the electronic tag (103) can be an active or passive tag as will be described in detail below. Other forms of electronic tagging may also be used. Any device that can be associated with the equipment (102) and communicate electronic data to identify the equipment (102) can be used as the electronic tag (103).

Personnel (100) will also be identified with an associated electronic personnel tag (101). As with the electronic equipment tag (103), the electronic personnel tag (101) can be any device that can be associated with a person (100) and communicate electronic data to identify that person (100). The electronic personnel tag (101) may be incorporated into anything that can be carried or worn by the person (100) who is identified by that tag (101). For example, the electronic personnel tag (101) may be incorporated into a badge, card, bracelet, necklace, pendant, watch, uniform, clothing, wallet, keychain, jewelry, footwear, headgear, mobile phone, writing instrument, etc.

A sensor (106) is used to create a detection field to monitor movement of the secured equipment (102). In the example of FIG. 1, the detection field (104) is created in front of a door (105) that is the exit from the storage room or location where the secured equipment (102) is typically kept.

When a person (100) wants to take and use the secured equipment (102), the person (100) and the equipment (102) will have to pass through the detection field (104) to exit by the door (105). When the electronic tag (103) on the secured equipment (102) enters the detection field (104), the sensor (106) communicates with the electronic tag (103) to obtain information that identifies the secured equipment (102) that has now been moved into the detection field (104). For example, the sensor (106) activates the transponder of the electronic tag (103) enabling the transfer of data from the tag (103) to the sensor (106).

Upon detection of secured equipment (102) in the detection field (104), the sensor (106) will also monitor for and detect the electronic personnel tag (101) of the person (100) moving the equipment into and through the detection field (104). Again, the sensor (106) communicates with the electronic personnel tag (101) to obtain information that identifies the person (100) that has moved the secured equipment (102) into the detection field (104) and toward the door (105).

The sensor (106) will then signal a server (107) that controls the system and advise the server (107) of the equipment (102) being moved and the identify of the person (100) taking the equipment (102), if a personnel tag (101) is detected. If no personnel tag (101) is detected, that data is also sent to the server (107).

The server (107) will match the identity of the person (100) with authorizations stored on the server (107) to move and use equipment. If the person (100) is authorized to move and use the identified equipment (102), the server (107) need take no action. However, in some embodiments, the server (107) will keep a log for each monitored piece of equipment including, for example, the time and date the equipment was accessed, the identity of the person accessing the equipment, how long the equipment was gone from the storage location, etc.

If the detected person (100) does not have authorization to move the equipment (102) or is unidentified because no electronic personnel tag (101) is detected, the server (107) can take action to prevent the person (100) from leaving the storage location with the secured equipment (102). For example, the server (107) can activate an alarm system (108).

The alarm system (108) can be any system that alerts security, management or other responsible personnel to the unauthorized movement of the equipment (102). The alarm system (108) can include any or all of a number of systems or devices for alerting responders to the unauthorized movement of the equipment (102). For example, the alarm system (108) may include an audible alarm. The audible alarm may be audible only where there are personnel who are responsible for responding to the unauthorized movement of the equipment (102). In other examples, the audible alarm may also be audible to the person (100) moving the equipment (102). The alarm system (108) may also include a visual alert to the unauthorized movement of the equipment (102). Additionally or alternatively, the alarm system (108) may transmit email, text, phone or other messages to personnel responsible for responding to the unauthorized movement of the equipment (102). Any system for alerting responders to the unauthorized movement of the equipment (102) can be incorporated into or used as the alarm system (108).

Consequently, unauthorized movement of the equipment (102) is prevented or at least discouraged, while authorized use of the equipment (102) is unimpeded. It will be understood by those skilled in the art that the detection field (104) does not have be associated exclusively with a door (105). Rather, the detection field (104) can be implemented at any location useful for monitoring the movement, authorized or otherwise, of the equipment (102). For example, the detection field (104) can be located in a hallway, an entryway, at a window, in a particular room, etc.

If two or more personnel are detected in the detection field along with secured equipment, either simultaneously or within a small time window, a warning may be triggered (e.g., a voice recording, lighted sign, simple colored light with legend on the wall indicating what the light means) to indicate that only the person with the secured equipment should pass through the detection zone first then the other person (or vice versa). The purpose of this being that the system will then be able to match correctly the person with the equipment and verify access rights accordingly.

Figure 2:
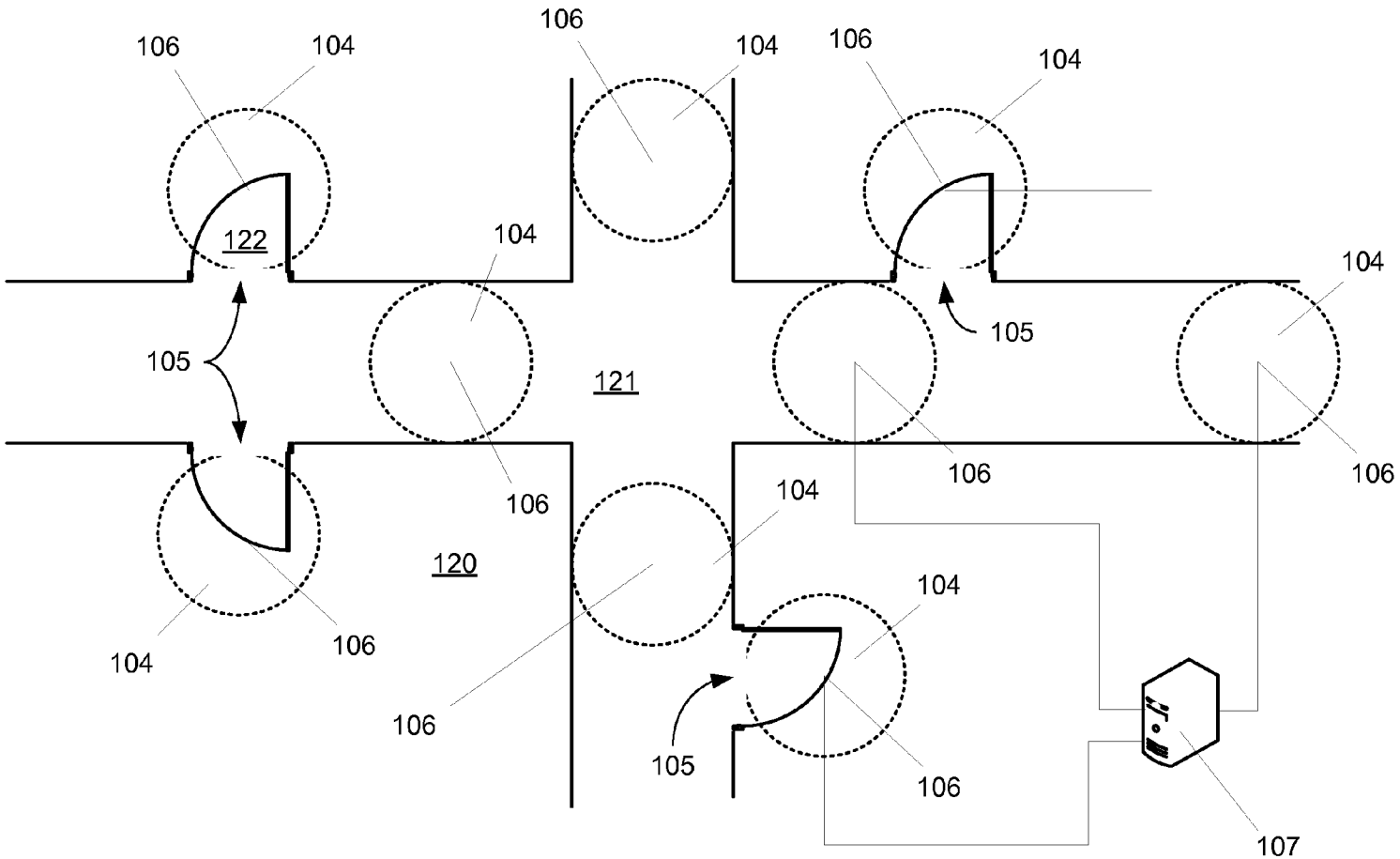
FIG. 2 is an illustration of a facility that incorporates an equipment monitoring system according to one exemplary embodiment of the principles described herein.

FIG. 2 is an illustration of a facility that incorporates an equipment monitoring system according to principles described herein. As shown in FIG. 2, a number of sensors (106) and corresponding detection fields (104) can be deployed throughout a facility (120). For example, detection fields (104) can be created in hallways (121) and doorways (122) such that the movement and location of the secured equipment (102) can be tracked by the server (107). As also shown in FIG. 2, the various sensors (106) of the security array are all networked to, or in communication with, the central server (107).

In this way, the server (107) can advise security or management personnel as to the location of the equipment (102). This is true whether the equipment was moved with or without authorization. In the event the equipment (102) was taken from a storage location without authorization, in addition to, or as an alternative to, activating the alarm system (108), the server (107) may use the other sensors (106) and other detection fields (104) to track the movement and location of the secured equipment (102). This will assist with the recovery of the equipment (102) taken without authorization.

In another scenario, if an authorized user removes the equipment (102) from a storage location, without activating the alarm system (108) or other response, but then gives the equipment (102) to an unauthorized or undetected person, the server (107) that is monitoring the entire facility (120) will note when the equipment (102) passes through a detection field (104) without a corresponding detection of an authorized personnel tag (101). At that point, the alarm system (108) can be activated as described above or some other response to the situation can be made.

Figure 3:
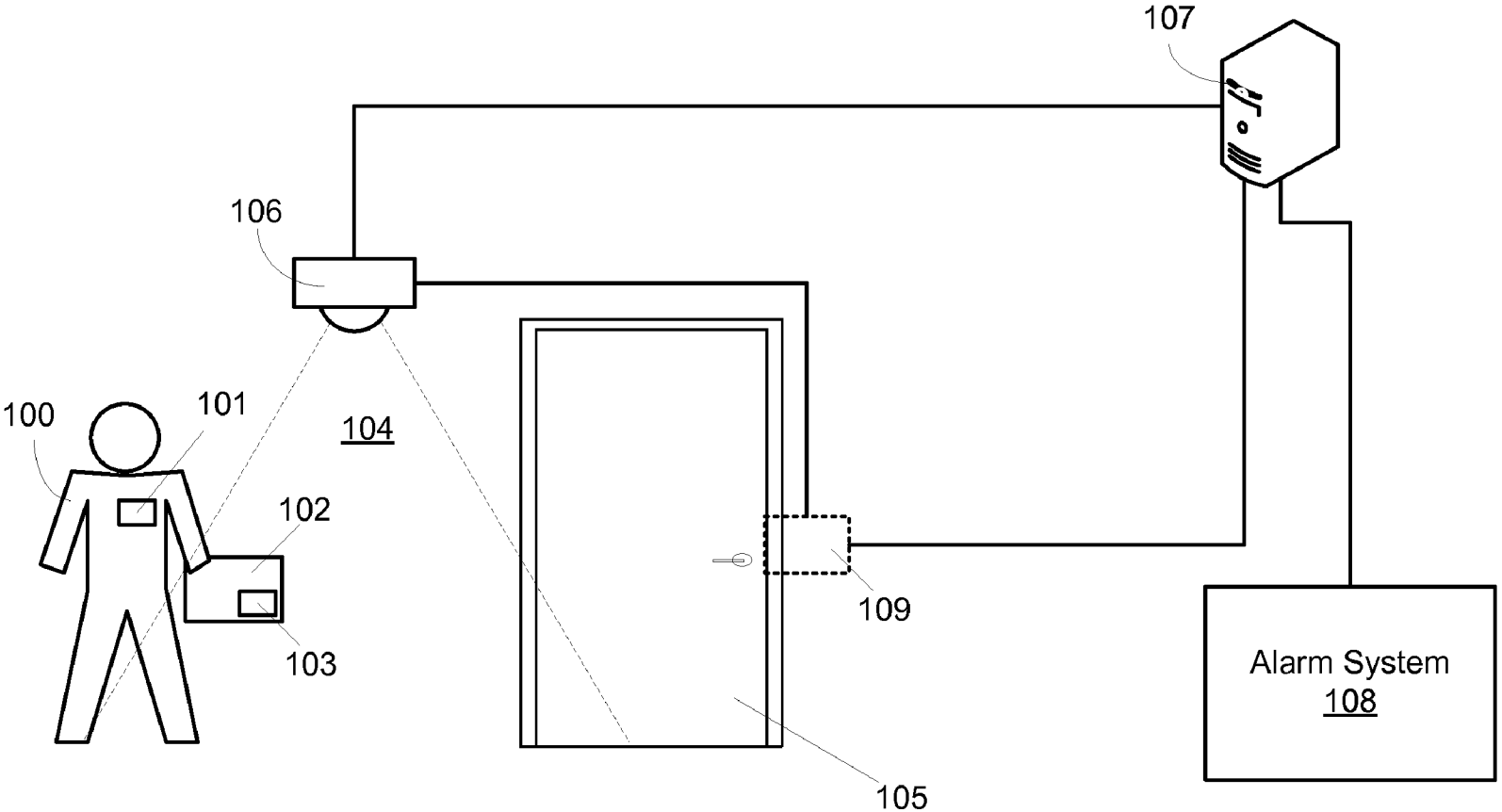
FIG. 3 is an illustration of a system according to one exemplary embodiment of the principles described herein that monitors both the removal of equipment from a storage location and the identity of the person moving the equipment.

FIG. 3 is an illustration of a system according to principles described herein that monitors both the removal of equipment from a storage location and the identity of the person moving the equipment. As shown in FIG. 3, the server (107) may also have control of a door locking mechanism (109) that secures the door (105) to the location where the equipment (102) is stored.

In this example, the server (107) can enable use of the door (105) for an authorized user of the equipment (102) or disable use of the door (105) for an unauthorized person moving the equipment (102). In some scenarios, the door (105) may be normally locked unless used by authorized personnel. In such a case, when the server (107) identifies a user (100) in the detection field (104) that is authorized to move the equipment (102) that has been identified in the detection field (104), the server (107) will release the door locking mechanism (109) to allow the person (100) to proceed. In other scenarios, the door (105) may normally be unlocked. However, when the server (107) identifies a user (100) in the detection field (104) that is unauthorized to move the equipment (102), or if the equipment (102) enters the detection field (104) and no personnel tag (101) is detected, the server (107) will engage the door locking mechanism (109) to prevent the equipment (102) from leaving the storage location.

In some examples, the sensor (106) may also have a direct connection with the door locking mechanism (108). In such embodiments, if the sensor (106) loses communication with the server (107), the sensor (106) may be programmed to engage the door locking mechanism (108) or keep the door locking mechanism (108) engaged until communication is restored with the server (107).

The preceding examples are particularly well suited to systems in which the electronic tags (101 and 103) are active, rather than passive. An active electronic tag may have its own power source, for example, a battery, and is therefore able to transmit data over a specific range, for example, 10-20 feet.

A passive electronic tag does not include a power source, but can be read electronically by a corresponding sensor when brought into proximity with that sensor. Thus, a passive electronic tag does not require the expense of a power source, but cannot be detected at as large a distance.

Figure 4:
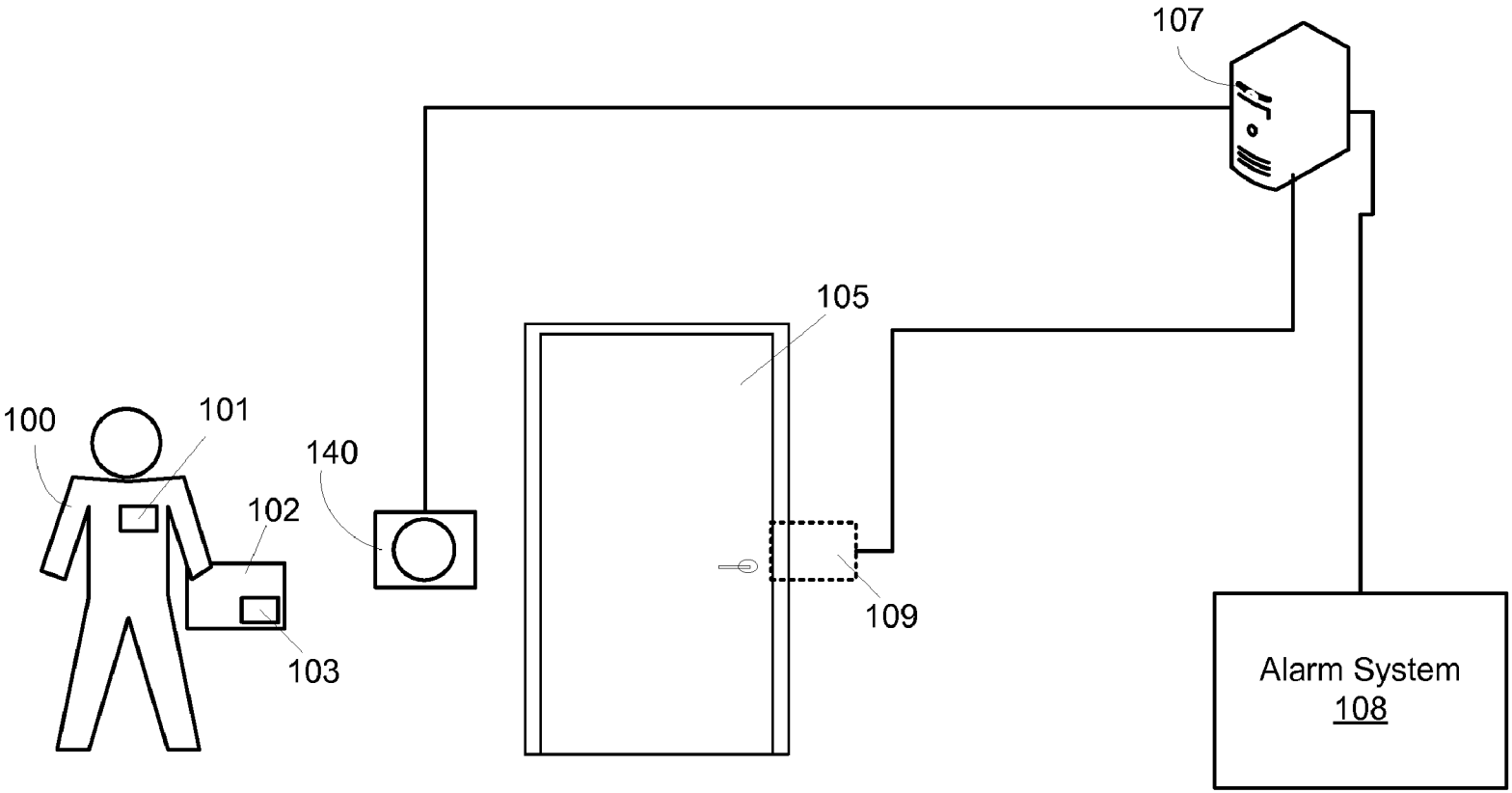
FIG. 4 is an illustration of a system according to one exemplary embodiment of the principles described herein that monitors both the removal of equipment from a storage location and the identity of the person moving the equipment.

FIG. 4 is an illustration of a system according to principles described herein that monitors both the removal of equipment from a storage location and the identity of the person moving the equipment. The system of FIG. 4 is particularly well suited for use with passive electronic tags.

As shown in FIG. 4, a passive electronic tag sensor or reader (140) is positioned at, for example, the egress (105) from the storage location for the equipment (102). To exit from the storage location, the person (100) taking the equipment (102) will hold the equipment (102) or the electronic tag (103) of the equipment (102) in close proximity to the sensor (140). The sensor (140) may issue a visual or audible cue when it has read the passive electronic tag (103) of the equipment (102).

The person (100) will then hold his or her electronic personnel tag (101) in close proximity to the sensor (104). Again, the sensor (140) may issue a visual or audible cue when it has read the passive electronic personnel tag (101).

As before, the server (107) will match the identity of the person (101) as determined by the electronic personnel tag (101) with equipment that person (101) is authorized to move or use. If the equipment (102) identified by the sensor (140) is equipment that the user (100) is authorized to move or use, the server (107) can disengage the locking mechanism (109) securing the door (105). The person (100) can then use the door (105) to leave the storage location with the equipment (102). If, on the other hand, the personnel tag (101) does not identify a person with authorization to move the equipment (102), or if no personnel tag (101) is presented and read, the server (107) will engage the locking mechanism (109) or keep the locking mechanism (109) engaged to prevent removal of the equipment (102) from the storage location.

Alternatively or in addition to use of the locking mechanism (109), the server (107) may activate an alarm system (108), as described herein, in response to an attempt to remove the equipment (102) from the storage location without authorization. Alternatively, the passive tags and the sensor (140) may be used in other systems that do not include the locking mechanism (109).

Figure 5:
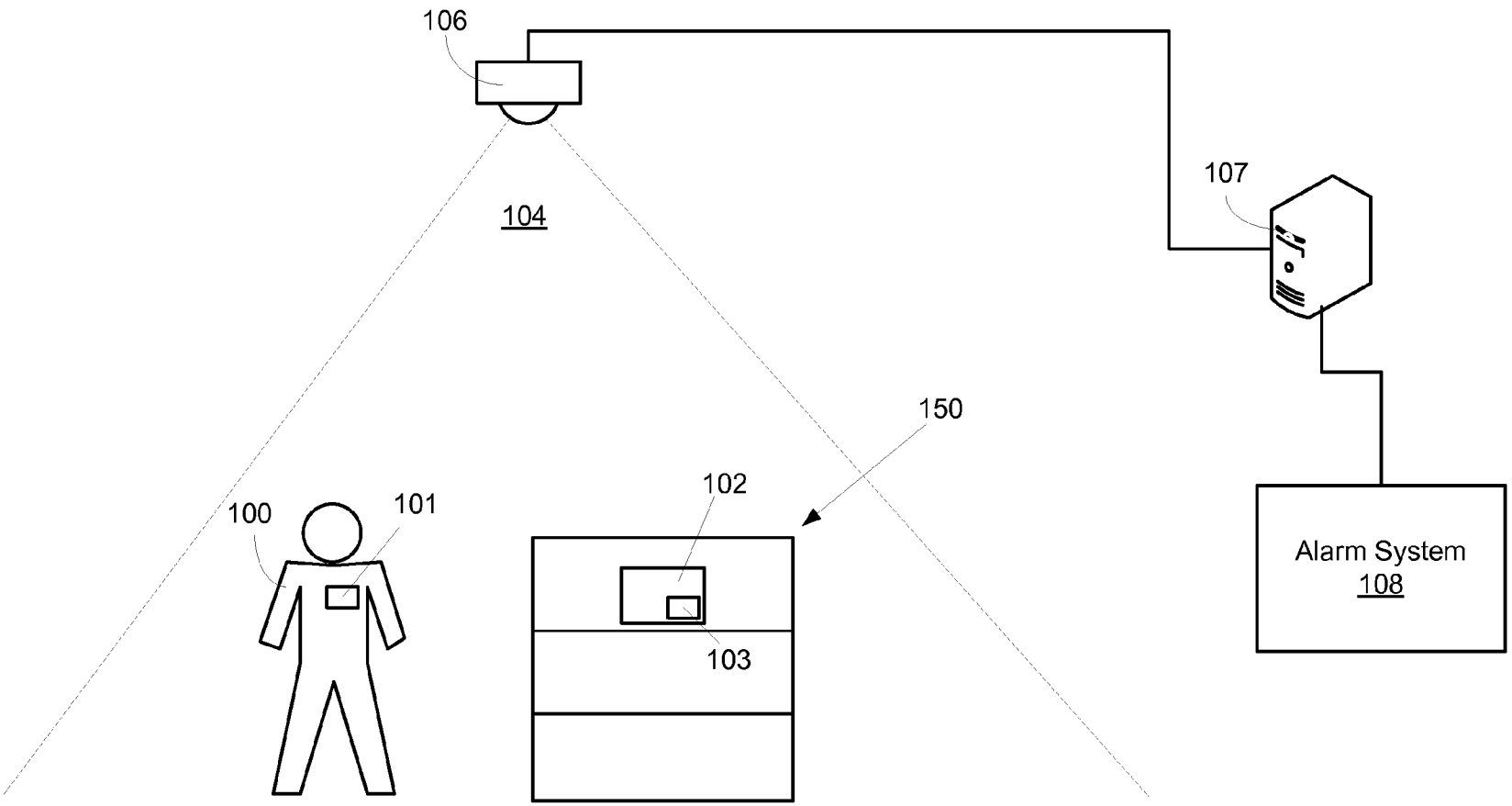
FIG. 5 is an illustration of a system according to one exemplary embodiment of the principles described herein that monitors both the removal of equipment from a storage location and the identity of the person moving the equipment.

FIG. 5 is an illustration of a system according to principles described herein that monitors both the removal of equipment from a storage location and the identity of the person moving the equipment. As shown in FIG. 5, a sensor (106) is used to create a detection field (104) that encompasses a storage location (150) for the equipment (102). Consequently, as long as the equipment (102) remains in the storage location (150), it will be within the detection field (104) and monitored by the sensor (106).

When a person (100) want to use the equipment (102), he or she can go to the storage location (150) and remove the equipment (102). The sensor (106) will also detect the entry of any electronic personnel tags (101) into the detection field (104). As before, the sensor (106) will signal the server (107) with the identification of the various pieces of secured equipment (102) in the detection field, using the associated electronic tags (103), and the identification of any personnel (100) in the detection field, using corresponding electronic personnel tags (101). The server (107) will match personnel identities with equipment lists that each person is authorized to move or use.

If equipment (102) leaves the detection field (104), the server (107) will match that equipment with an electronic personnel tag (101) that has also left the detection field (104) at the same time. The server (107) will then determine if the person identified by that electronic personnel tag (101) is authorized to move or use the equipment (102) that has just left the detection field (104). If so, the server (107) need take no action. If, however, the person who has just left the detection field (104) is not authorized for the equipment (102) that has also contemporaneously left the detection field (104), the server (107) can activate the alarm system (108) or take any of the other measures described herein or otherwise to alert responsible personnel to the unauthorized movement of the equipment (102) or to prevent removal of the equipment (102) from the storage location (150).

Additionally, the system may keep a log of all tagged personnel that enter the detection field (104) and the time each person is detected entering and/or leaving the detection field (104). This will allow security or other responsible personnel to determine who was in the detection zone and near the secured equipment during a given period of time.

Figure 6:
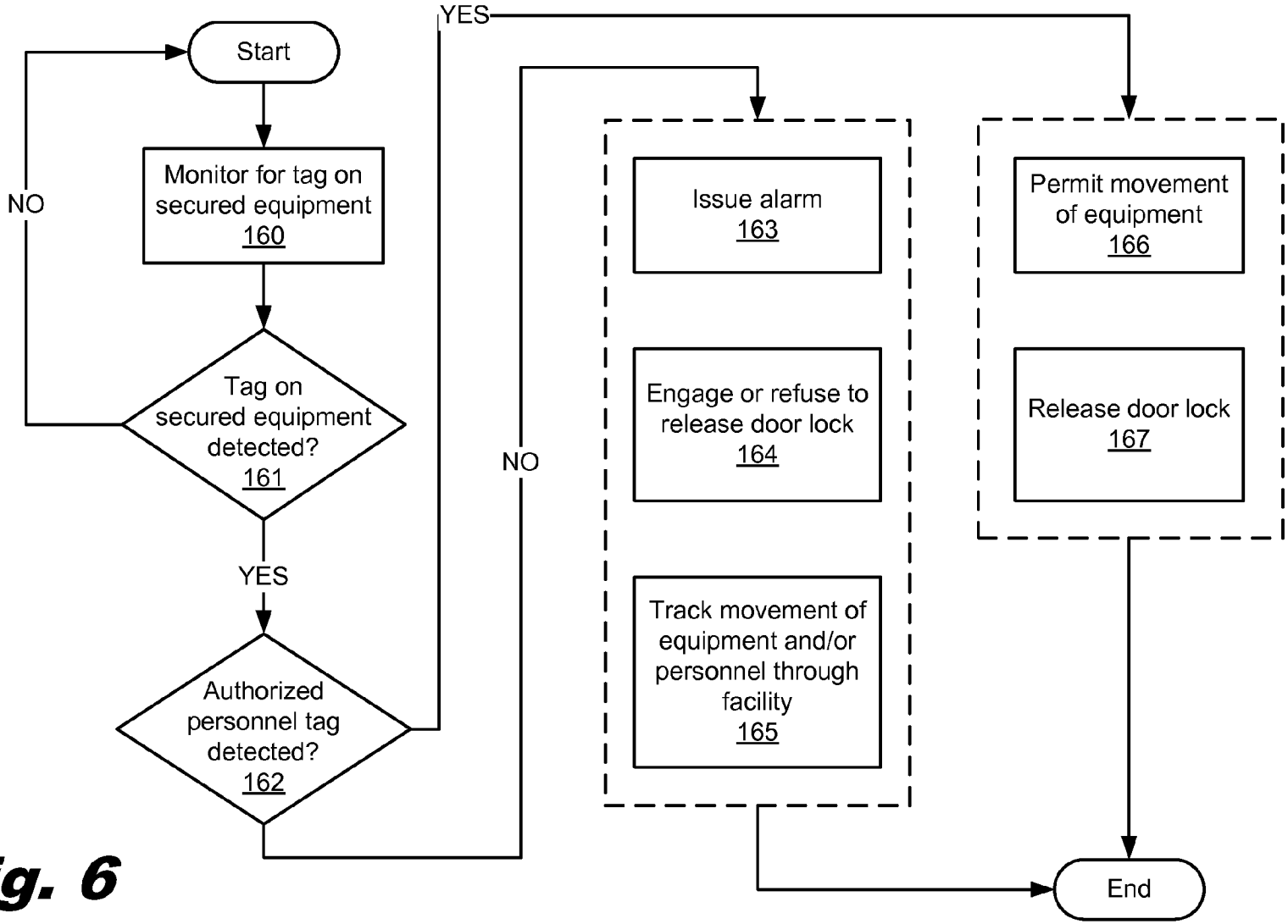
FIG. 6 is a flow chart illustrating a method of operating a system according to one exemplary embodiment of the principles described herein that monitors both the removal of equipment from a storage location and the identity of the person moving the equipment.

FIG. 6 is an illustration of a method of operating a system according to principles described herein that monitors both the removal of equipment from a storage location and the identity of the person moving the equipment. As shown in FIG. 6, the method begins with monitoring for an electronic tag on a piece of secured equipment (step 160). This is performed using the detection fields described above.

If an electronic tag on secured equipment is detected (determination 161), the system then identifies any electronic personnel tags in the same detection field as the detected equipment. The method then determines whether the person corresponding to that personnel tag is authorized to move or use the identified equipment (determination 162).

If the secured equipment is detected with, i.e., in the possession of, an authorized user (determination 162), the method will permit movement of the equipment (step 166)

without activating any alarm system. If needed, the method will also include releasing a door locking mechanism (step 167) to permit the removal of the equipment.

If, however, the secured equipment is detected in the detection field along with the electronic personnel tag of an unauthorized user or no identified person at all (determination 162), the method will include any or all of at least three protective responses. Specifically, the method may include issuing an alarm (step 163), for example, with the alarm system described herein. Additionally or alternatively, the method may include engaging or refusing to release a door locking mechanism (step 164) on a door that bars removal of the protected equipment. Additionally or alternatively, the method may include tracking the movement of the equipment and/or person moving the equipment (step 165) using an array of sensors and detection fields as illustrated, for example, in FIG. 2 and as described above.

Figure 7:
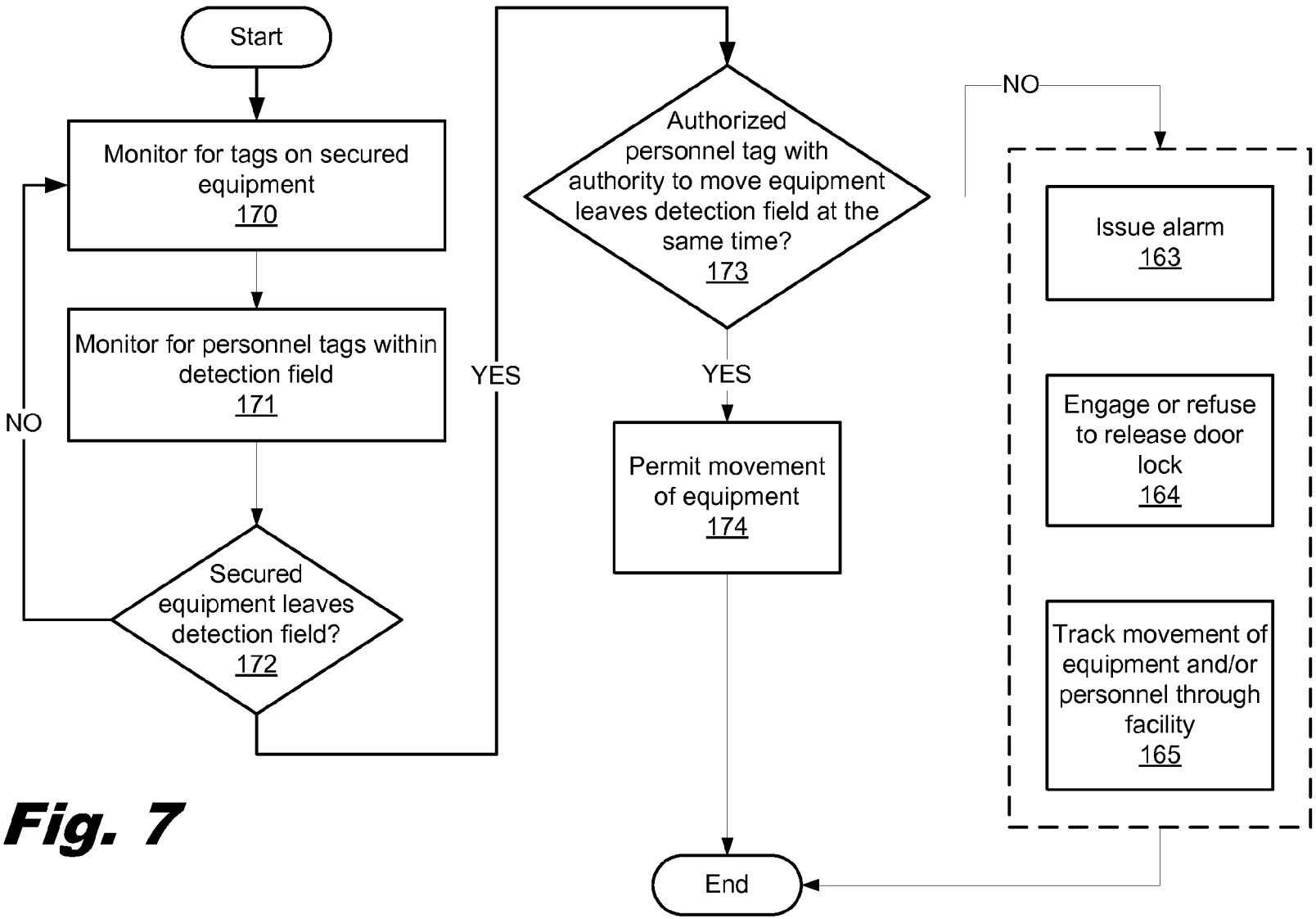
FIG. 7 is a flow chart illustrating a method of operating a system according to one exemplary embodiment of the principles described herein that monitors both the removal of equipment from a storage location and the identity of the person moving the equipment.

FIG. 7 is an illustration of a method of operating a system according to principles described herein that monitors both the removal of equipment from a storage location and the identity of the person moving the equipment. As shown in FIG. 7, the method begins with monitoring for tags on secured equipment (step 170) that are stored in a storage location encompassed within a detection field as illustrated, for example, in FIG. 5. As described above, the identification of the secured equipment that is within the storage location and detection field will be continually signaled to a server operating the system.

The method also monitors for electronic personnel tags in the detection field (step 171). This monitoring includes signaling the server with the identification of the personnel so detected.

If a piece of secured equipment that has been in the detection field is no longer detected (determination 172), the method notes the removal of that equipment. The method, as implemented, for example, by the server (107) described above, then identifies a personnel tag that left the detection field contemporaneously with the monitored equipment. The method then determines if the person corresponding to that personnel tag has authorization to move or use the secured equipment that has also just left the detection field (determination 173).

If the method determines that the equipment was moved from the detection field by an authorized user (determination 173), the method permits the movement of the equipment (174). This may include release a door locking mechanism to permit removal of the equipment.

Alternatively, if the method determines that no authorized personnel tag has left the detection field along with the monitored equipment (step 173), the method will take measures to prevent the unauthorized removal or use of the monitored equipment. For example, the method may include issuing an alarm (163), such as by activating an alarm system as described above. Additionally or alternatively, the method may include engaging or refusing to release a door locking mechanism so as to prevent egress of the unauthorized person with the secured equipment (164). Additionally or alternatively, the method may include tracking the movement of the equipment and/or person moving the equipment (step 165) using an array of sensors and detection fields as illustrated, for example, in FIG. 2 and as described above.

As will be appreciated by those skilled in the art, any of the methods or systems described herein can be used to simultaneously monitor the location and security of any number of secured pieces of equipment. The methods and system are certainly not restricted to monitoring a single piece of equipment.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A system for monitoring equipment, said system comprising:

at least one sensor for generating a detection field;

an electronic equipment tag associated with a piece of secured equipment;

an electronic personnel tag identifying a person;

a server, in communication with said at least one sensor, for matching detection in said detection field of said equipment tag with detection in said detection field of a personnel tag and determining whether a person identified by the detected personnel tag is authorized to use equipment corresponding to the detected equipment tag; and a warning system controlled by said server that is triggered when two or more personnel tags are detected within said detection field, said warning system indicating that only one person may leave the detection field with a piece of secured equipment at a time so that said sewer can match a personnel tag of a person exiting said detection field with a corresponding electronic equipment tag of secured equipment being removed.

2. The system of claim 1, farther comprising an alarm system in communication with said server, wherein said server activates said alarm system if movement of said equipment and equipment tag is detected without concurrent detection of a personnel tag identifying a person authorized to move or use that equipment.

3. The system of claim 2, wherein said alarm system comprises a visual or audible alarm.

4. The system of claim 2, wherein said alarm system comprises a messaging system.

5. The system of claim 1, further comprising a plurality of sensors generating a plurality of detection fields throughout a facility such that said server can track movement and location of said equipment tag, said personnel tag or both.

6. The system of claim 1, wherein said server comprises a log in which is recorded when and by whom pieces of secured equipment are moved as determined by detection of said equipment tag and personnel tag in said detection field.

7. The system of claim 1, further comprising a door locking mechanism operated by said server for selectively locking and unlocking a door to prevent unauthorized removal of said piece of secured equipment from a storage location.

8. The system of claim 1, wherein either said equipment tag or said personnel tag is a passive electronic tag and said sensor comprises a passive electronic tag sensor.

9. The system of claim 1, wherein said detection field encompasses a storage location of said piece of secured equipment.

10. The system of claim 9, wherein said server detects removal of said piece of equipment from said detection field based on losing a signal from the equipment tag associated with that piece of equipment, said server also identifying a personnel tag that leaves said detection field contemporaneously with said equipment tag, wherein said server takes measures to prevent removal of said piece of equipment unless the personnel tag detected leaving the detection field contemporaneously with the piece of equipment identifies a user authorized to remove said piece of equipment.

11. A method of monitoring equipment, said method comprising:

detecting an electronic equipment tag associated with a piece of secured equipment in a detection field;

detecting a personnel tag identifying a person in said detection field;

triggering a warning system when two or more personnel tags are detected within said detection field, said warning system indicating that only one person may leave the detection field with a piece of secured equipment at a time; and determining if a person identified by a detected personnel tag who is leaving the detection field is authorized to use a corresponding piece of secured equipment having a detected equipment tag which is being removed from the detection field.

12. The method of claim 11, further comprising taking measures to prevent removal of said piece of equipment if the person identified by the detected personnel tag is not authorized to use said piece of equipment corresponding to the detected equipment tag.

13. The method of claim 12, wherein taking said measures to prevent removal of said piece of equipment comprises issuing an alarm.

14. The method of claim 13, wherein taking said measures to prevent removal of said piece of equipment comprises automatically locking a door.

15. The method of claim 13, wherein taking said measures to prevent removal of said piece of equipment comprises tracking movement of either said person or said piece of equipment using a plurality of detection fields disposed throughout a facility.

16. The method of claim 11, further comprising releasing a door locking mechanism if the person identified by the detected personnel tag is authorized to use said piece of equipment corresponding to the detected equipment tag.

17. The method of claim 11, further comprising:

detecting removal of said piece of equipment from said detection field based on losing a signal from the equipment tag associated with that piece of equipment;

identifying a personnel tag that leaves said detection field contemporaneously; and taking measures to prevent removal of said piece of equipment unless the personnel tag detected leaving the detection field contemporaneously with the piece of equipment identifies a user authorized to remove said piece of equipment.

18. The method of claim 17, wherein taking said measures to prevent removal of said piece of equipment comprises issuing an alarm.

19. The method of claim 17, wherein taking said measures to prevent removal of said piece of equipment comprises automatically locking a door.

20. The method of claim 17, wherein taking said measures to prevent removal of said piece of equipment comprises tracking movement of either said person or said piece of equipment using a plurality of detection fields disposed throughout a facility.

21. A system for monitoring equipment, said method comprising:

means for detecting an electronic equipment tag associated with a piece of secured equipment in a detection field;

means for detecting a personnel tag identifying a person in said detection field;

means for determining if the person identified by the detected personnel tag is authorized to use equipment corresponding to the detected equipment tag; and means for issuing a warning that only one person may leave the detection field with a piece of secured equipment at a time when two or more personnel tags are detected within said detection field so that said means for determining can match a particular personnel tag leaving said detection field with a particular equipment tag of secured equipment being removed from said detection field.

* * * * *

UNITED STATES PATENT AND TRADEMARK OFFICE

CERTIFICATE OF CORRECTION

PATENT NO. : 7,557,712 B2
APPLICATION NO. : 11/540872
DATED : July 7, 2009
INVENTOR(S) : Jerry Shelton et al.

It is certified that error appears in the above-identified patent and that said Letters Patent is hereby corrected as shown below:

In column 8, line 24, in claim 1, delete "sewer" and insert -- server --, therefor.

In column 8, line 28, in claim 2, delete "farther" and insert -- further --, therefor.

Signed and Sealed this

Sixth Day of July, 2010

David J. Kappos

David J. Kappos
*Director of the United States Patent and Trademark Office*